US006394446B1

(12) United States Patent
Okamoto

(10) Patent No.: US 6,394,446 B1
(45) Date of Patent: May 28, 2002

(54) REVERSE FEEDING DEVICE

(75) Inventor: Masami Okamoto, Yamato (JP)

(73) Assignee: Ricoh Company, LTD, Tokyo (JP)

( * ) Notice: Subject to any disclaimer, the term of this patent is extended or adjusted under 35 U.S.C. 154(b) by 0 days.

(21) Appl. No.: 09/521,385

(22) Filed: Mar. 8, 2000

(30) Foreign Application Priority Data

Mar. 8, 1999 (JP) ..... 11-060230

(51) Int. Cl.[7] ..... B65H 29/00; B65H 39/10; G03G 15/00

(52) U.S. Cl. ..... 271/186; 271/303; 399/364

(58) Field of Search ..... 271/186, 188, 271/184, 296, 297, 303, 304, 305; 399/364

(56) References Cited

U.S. PATENT DOCUMENTS 5,984,305 A * 11/1999 Inoue ..... 271/291 X

FOREIGN PATENT DOCUMENTS

| | | | | |
|---|---|---|---|---|
| JP | 6-332340 A | * | 12/1994 | ..... G03G/21/00 |
| JP | 8-40622 | | 2/1996 | |
| JP | 10-35980 A | * | 2/1998 | ..... B65H/29/58 |
| JP | 10-218455 | | 8/1998 | |
| JP | 11-11806 A | * | 1/1999 | ..... B65H/85/00 |
| JP | 11-24334 | | 1/1999 | |

* cited by examiner

*Primary Examiner*—Donald P. Walsh
*Assistant Examiner*—Kenneth W Bower
(74) *Attorney, Agent, or Firm*—Oblon, Spivak, McClelland, Maier & Neustadt, P.C.

(57) ABSTRACT

A reverse feeding apparatus for switching back and feeding a sheet, includes at least one feeding roller positioned for feeding a sheet in a first direction from an upstream path to a downstream path; a reverse feeding roller located at the downstream path and positioned for feeding a sheet in a second direction that is different from the first direction; at least one branch nail movably mounted adjacent the feeding roller; at least one guiding nail movably mounted adjacent the feeding roller, wherein a tip of the branch nail and a tip of the guiding nail are positionable to overlap the feeding roller when the sheet is not being fed in the first direction by the feeding roller, a branch nail pressing device which presses the branch nail to the position overlapping the feeding roller to increase friction between a sheet being fed in the first direction and the feeding roller; and a guiding nail pressing device which presses the guiding nail to the position overlapping the feeding roller to permit a front end of a sheet being fed in the second direction to pass by a lower face of the guiding nail. The pressure applied by the guiding nail pressing device is smaller than the pressure applied by the branch nail pressing device. The pressure applied by the guiding nail pressing device is set such that the inertial movement of a sheet moving in the upstream path is not obstructed by the guiding nail. Therefore, the guiding nails are less likely to cause paper jamming.

15 Claims, 8 Drawing Sheets

REVERSE FEEDING DEVICE

CROSS-REFERENCE TO RELATED APPLICATIONS

The present document incorporates by reference the entire contents of Japanese priority document, 11-60230 filed in Japan on Mar. 8, 1999.

BACKGROUND OF THE INVENTION

1. Field of the Invention

The present invention relates to devices such as a copy machine, a printer and a facsimile, that can print on both sides of a sheet or that can turn a sheet upside down.

2. Discussion of the Background

A conventional reverse feeding device as shown in FIG. 7, has plural feeding rollers 101, feeding rollers 100, branch selector 104, reverse feeding rollers 102 and plural feeding rollers 103. The feeding rollers 101 transport a paper P to an area of the feeding roller 100 and the branch selector 104 while guiding the paper P along a guiding face 104*a*. Then, the feeding rollers 100 transport the paper P to a switch back path SB. The reverse feeding rollers 102 then transport the paper P to the feeding rollers 103 while guiding the paper P along a reverse guiding face 104*b*.

FIG. 8 shows a top view of the feeding rollers 100 and the branch selector 104. Plural feeding rollers 100 are rotatably supported by an shaft 106. The branch selector 104 comprises a plurality of selector elements (nails) movably supported by a shaft 107 and located very near to the feeding rollers 100. Tips of the branch nails 104 overlap the feeding rollers 100, as shown in FIG. 8. FIG. 9(*a*), (*b*) are side views of the feeding rollers 100 and the branch nails 104. FIG. 9(*a*) shows a condition where there is no paper between the feeding rollers 100 and the branch nails 104. When the paper P is transported between the feeding rollers 100 and the branch nails 104, the tips of the branch nails 104 press on the paper P. On the other hand, the paper P is pressed toward the axis 106 by the branch nails 104. Accordingly, friction between the paper P and the feeding rollers 100 is increased and the paper P is transported reliably by the feeding rollers 100.

As shown in FIG. 8, guiding nails 105, which are similar to the branch nails 104, are also supported by the shaft 107. The guiding nails 105 are located farther than the branch nails 104 from the feeding rollers 100. Tips of the guiding nails 105 do not overlap the feeding rollers 100, as shown in FIG. 8. These guiding nails 105 do not have a function of pressing the paper P toward the feeding rollers 100, but instead have a function of guiding the paper P when the paper P is transported form the switch-back path SB to the feeding rollers 103.

Next we explain the reason why the guiding nails 105 do not overlap the feeding rollers. A recent model printer can print on a tab-paper Pt, as shown in FIG. 11. When using the tab-paper Pt, the tab-paper Pt is transported through the machine and through the reverse feeding device. When a printing area PP of the tab-paper Pt is transported between the branch nails 104 and the feeding rollers 100, the feeding power of the feeding rollers 100 is fully transferred to the tab-paper. However, after the printing area PP passes the branch nails 104 and the feeding rollers 100, transportation of the tab-paper may depend on the inertia of the tab-paper, since the tab area Ptab of the tab-paper Pt may not be caught by the nearest feeding roller 100. If the guiding nail 105' overlaps the feeding rollers 100, as shown in FIG. 10, the tab area will be pressed by the guiding nail 105', and this pressure will stop the transportation of the tab-paper Pt against its inertia. But since the tips of the guiding nails 105 are formed not to overlap the feeding rollers 100, as shown in FIG. 9(*c*), this does not occur.

However, as there are then gaps X between the guiding nails 105 and the feeding rollers 100 as shown in FIG. 9(*c*), when the paper P is transported by reverse feeding rollers 102, a front-end of the paper becomes embedded in the gaps X, and a paper jam occurs. This is especially a problem for a sheet after passing through a fixing device, as side edges of the paper are curved, and the risk of the paper jam increases.

SUMMARY OF THE INVENTION

Accordingly, one object of this invention is to provide a novel reverse feeding device which can feed a paper with stability.

It is another object of the invention to provide a reverse feeding device with a reduced risk of paper jamming.

According to a feature of the invention, the above and other objects are achieved by a reverse feeding apparatus for switching back and feeding a sheet, comprising at least one feeding roller positioned for feeding a sheet in a first direction from an upstream path to a downstream path; a reverse feeding roller located at the downstream path and positioned for feeding a sheet in a second direction that is different from the first direction; at least one branch nail movably mounted adjacent the feeding roller; at least one guiding nail movably mounted adjacent the feeding roller, wherein a tip of the branch nail and a tip of the guiding nail are positionable to overlap the feeding roller when the sheet is not being fed in the first direction by the feeding roller, a branch nail pressing device which presses the branch nail to the position overlapping the feeding roller to increase friction between a sheet being fed in the first direction and the feeding roller; and a guiding nail pressing device which presses the guiding nail to the position overlapping the feeding roller to permit a front end of a sheet being fed in the second direction to pass by a lower face of the guiding nail. The pressure applied by the guiding nail pressing device is smaller than the pressure applied by the branch nail pressing device.

According to this feature, the pressure applied by the guiding nail pressing device is set such that the inertial movement of a sheet moving in the upstream path is not obstructed by the guiding nail. Therefore, the guiding nail is less likely to cause paper jamming.

According to another feature of the invention, the above and other objects are achieved by a reverse feeding apparatus for switching back and feeding a sheet, comprising feeding roller means for feeding a sheet in a first direction from an upstream path to a downstream path; reverse feeding roller means for feeding a sheet in a second direction that is different from the first direction; at least one branch nail movably mounted adjacent the feeding roller means; at least one guiding nail movably mounted adjacent the feeding roller means, wherein a tip of the branch nail and a tip of the guiding nail are positionable to overlap the feeding roller means when the sheet is not being fed in the first direction by the feeding roller means, branch nail pressing means for pressing the branch nail to the position overlapping the feeding roller means to increase friction between a sheet being fed in the first direction and the feeding roller means; and guiding nail pressing means for pressing the guiding nail to the position overlapping the feeding roller means to permit a front end of a sheet being fed in the second direction to pass by a lower face of the guiding nail. The pressure applied by the guiding nail pressing means is smaller than the pressure applied by the branch nail pressing means.

According to this feature, the pressure applied by the guiding nail pressing means is set such that the inertial movement of a sheet moving in the upstream path is not obstructed by the guiding nail. Therefore, the guiding nail is less likely to cause paper jamming.

According to yet another feature of the invention, the above and other objects are achieved by a method for switching back and feeding a sheet, comprising the steps of using at least one feeding roller to feed a sheet in a first direction from an upstream path to a downstream path; using a reverse feeding roller located at the downstream path to feed the sheet in a second direction that is different from the first direction; using at least one branch nail movably mounted adjacent the feeding roller to press the paper sheet being fed in the first direction toward the at least one feeding roller; and using at least one guiding nail movably mounted adjacent the feeding roller to guide the sheet being fed in the second direction without obstructing the inertial movement of the sheet in the first direction.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 3(*b*) shows a case where a paper leaves the area between the feeding rollers and the branch nails;

FIG. 5(*b*) shows a modification of the construction of the branch nails and the guiding nails;

FIG. 9(*b*) is a side view of the feeding rollers and the branch nails of FIG. 7 when there is paper between them;

FIG. 9(*c*) is a side view of the feeding rollers and the guiding nails of FIG. 7;

DESCRIPTION OF THE PREFERRED EMBODIMENT

The following is a description of an exemplary embodiment of the present invention as illustrated in the accompanying figures.

Figure 1:
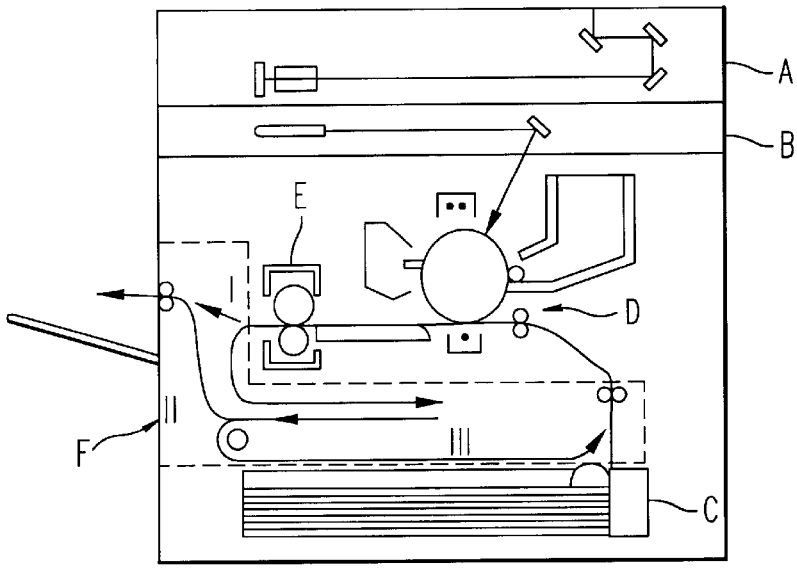
FIG. 1 is a side elevation view of an image forming apparatus having a reverse feeding device of the invention.

FIG. 1 is an outline construction of an image forming apparatus having a reverse feeding device of the invention. This image forming apparatus has a scanning device A for scanning a manuscript, a writing device B for writing latent image, a paper supplying device C for accommodating and supplying papers, an image forming device D for forming a visible toner image on the papers, a fixing device E for fixing the toner image by fusing the toner image, and an ejecting device F for ejecting the paper.

Figure 2:
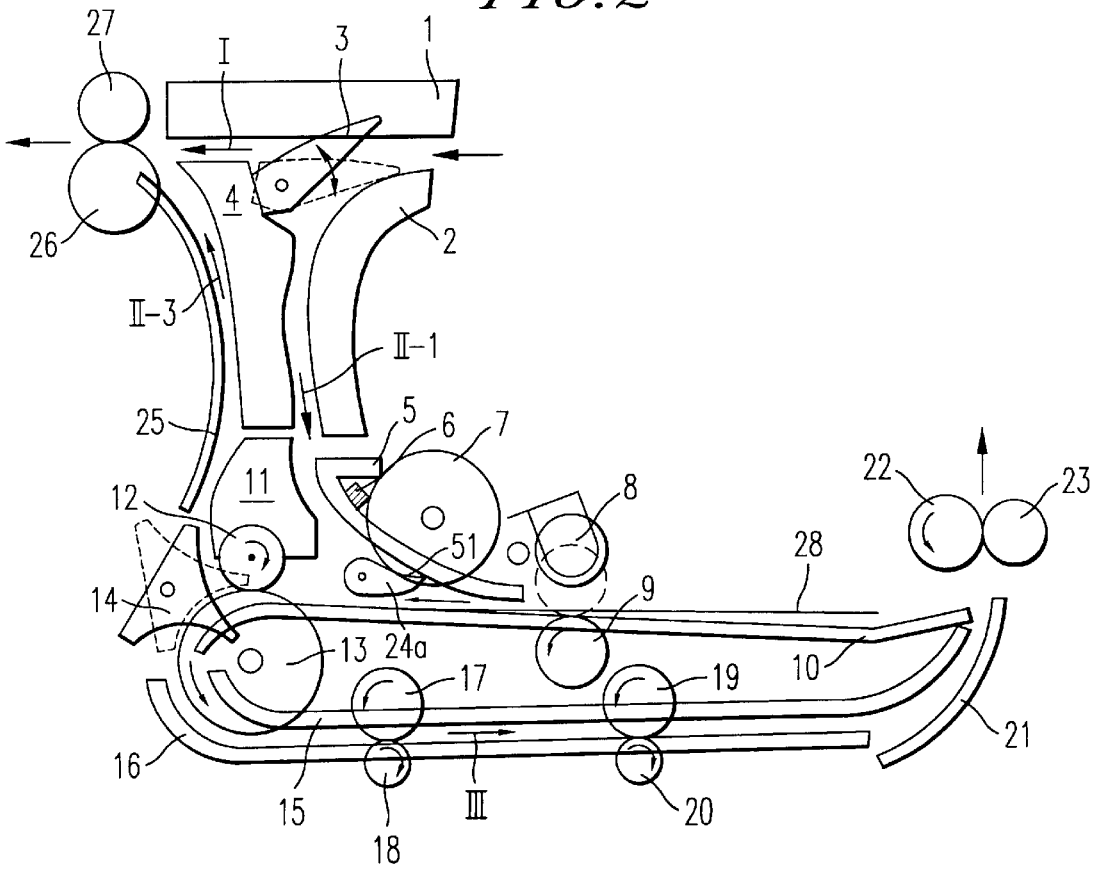
FIG. 2 is a detail of the reverse feeding device in the image forming apparatus of FIG. 1.

Referring to FIG. 2, the ejecting device F has a reverse feeding device for switching the paper path and/or feeding it back to the image forming device D instead of a ejecting tray. A path I is a normal ejecting path by which a paper is ejected. A path II is switch back ejecting path by which a paper is switched back in the reverse feeding device and then ejected. A path III is a refeeding path by which a paper is switched back by the reverse feeding device and again fed to the image forming device D in order to print on back side of the paper.

FIG. 2 is a detail of the reverse feeding device. A paper fixed by the fixing device E is fed to a branch point while being guided by an tipper guide plate 1 and a lower guide plate 2. A branch nail 3 is set at the branch point. When the branch nail 3 is at lower position shown in dotted lines, the paper is fed through the path I. When the branch nail 3 is at upper position shown in a solid line in FIG. 2, the paper is fed through the path II-1 which is made of the lower guide plate 2, a middle guide plate 4, a reverse feeding entrance guide plate 5, and a reverse feeding lower entrance guide plate 11. A sensor 6 for sensing a back end of the paper is set at the reverse feeding entrance guide plate 5. Plural feeding rollers 7 and plural branch nails 24*a* are placed downstream of the sensor 6. Tips of the branch nails 24*a* can apply pressures upward. Two or more feeding rollers 7 and branch nails 24*a* are arranged spaced from one another in a direction parallel to the plane of FIG. 2. The tips of the branch nails 24*a* overlap the feeding rollers 7 in a staggered or interleaved configuration. The branch nails 24*a* are pivotally mounted on a shaft 24*c*, and are biased to rotate in a counter clockwise direction (as seen in FIG. 2), for example by a spring (described below). When a paper 28 is transported between the feeding rollers 7 and the branch nails 24*a*, the tips of the branch nails 24*a* are pressed down by the paper 28. On the other hand the paper 28 is pressed upward by the branch nails 24*a*. Accordingly, the friction between the paper 28 and the feeding rollers 7 is increased and so the paper 28 is transported to a switch back feeding plate 10 by the feeding rollers 7.

A predetermined time after a back-end of the paper has been sensed by the sensor 6, a reverse roller 8 is lowered to the position shown in dotted lines, and comes into contact with the paper 28. Then the direction of movement of the paper 28 is reversed, and it is fed to feeding rollers 12 and 13 through a path II-2. When the paper 28 is caught between the feeding rollers 12 and 13, the reverse roller 8 is raised as shown in a solid line.

When a branch nail 14 is set, as shown, in the solid line position, the paper 28 is fed to ejecting rollers 26 and 27 through a path II-3 that is made of the middle plate 4 and a outer plate 25, and then ejected outside the machine. On the other hand, when the branch nail 14 is moved to the dotted line position, the paper 28 is again fed to the image forming device D through the path III to print on the reverse side of the paper 28. The path III is made of an upper plate 15 and a lower plate 16. Feeding rollers 17 and 18, and feeding rollers 19 and 20, are located partway along the path III.

Figure 3A:
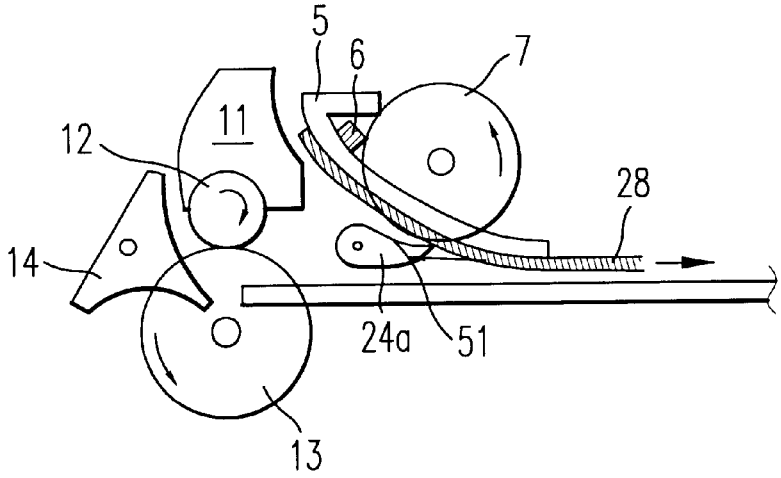
FIG. 3(*a*) shows a case where a paper sheet is fed by the feeding rollers while being guided by the upper faces of the branch nails.
Figure 3B:
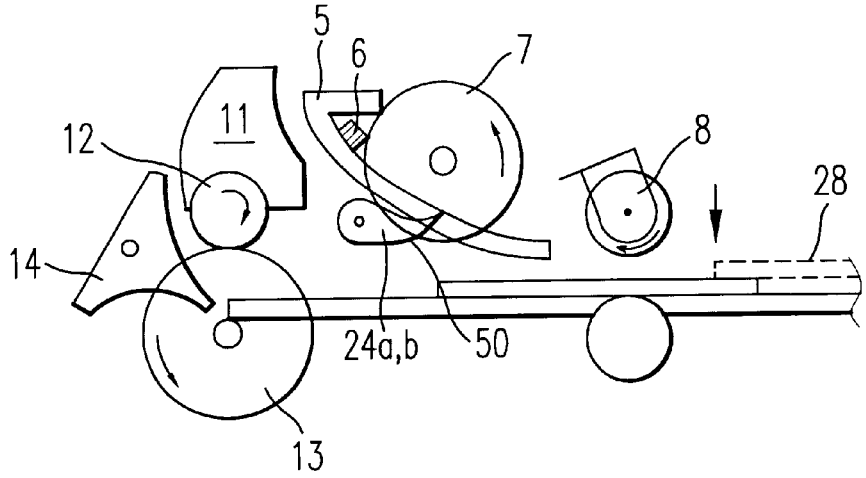

FIG. 3(*a*) shows a case where the paper 28 is fed by the feeding rollers 7 while being guided by the upper faces 51 of the branch nails 24*a*. FIG. 3(*b*) shows a case where the paper 28 leaves the area between the feeding rollers 7 and the branch nails 24*a*. After this time, the back-end of the paper 28 becomes a front end as the paper 28 is reverse fed by the reverse feeding roller 8 while being guided by lower faces 50 of the branch nails 24*a*.

Figure 4:
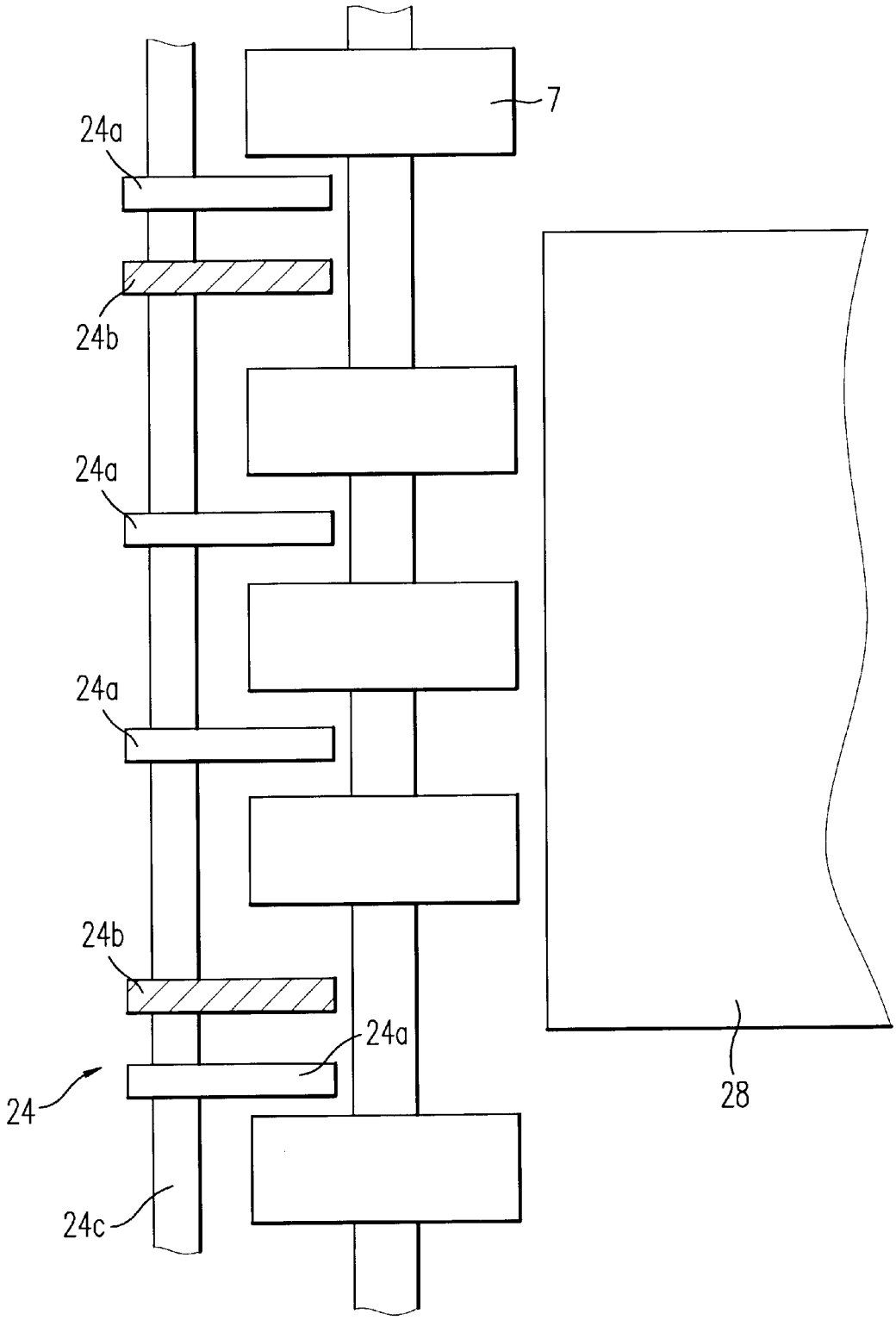
FIG. 4 is a top view of the case shown in FIG. 3(*b*)

FIG. 4 is a top view of the case shown in FIG. 3(*b*). Central feeding rollers 7 are located at central region corresponding to where the paper 28 passes through. The branch nails 24*a* are located between the central feeding rollers 7 in a staggered or interleaved format. To increase friction between the paper 28 and the feeding rollers 7, or equivalently to press the paper 28 to the feeding rollers 7 with reliability, the branch nails 24*a* are positioned very close to the feeding rollers 7 in the axial direction of the shaft 24*c*.

Figure 6:
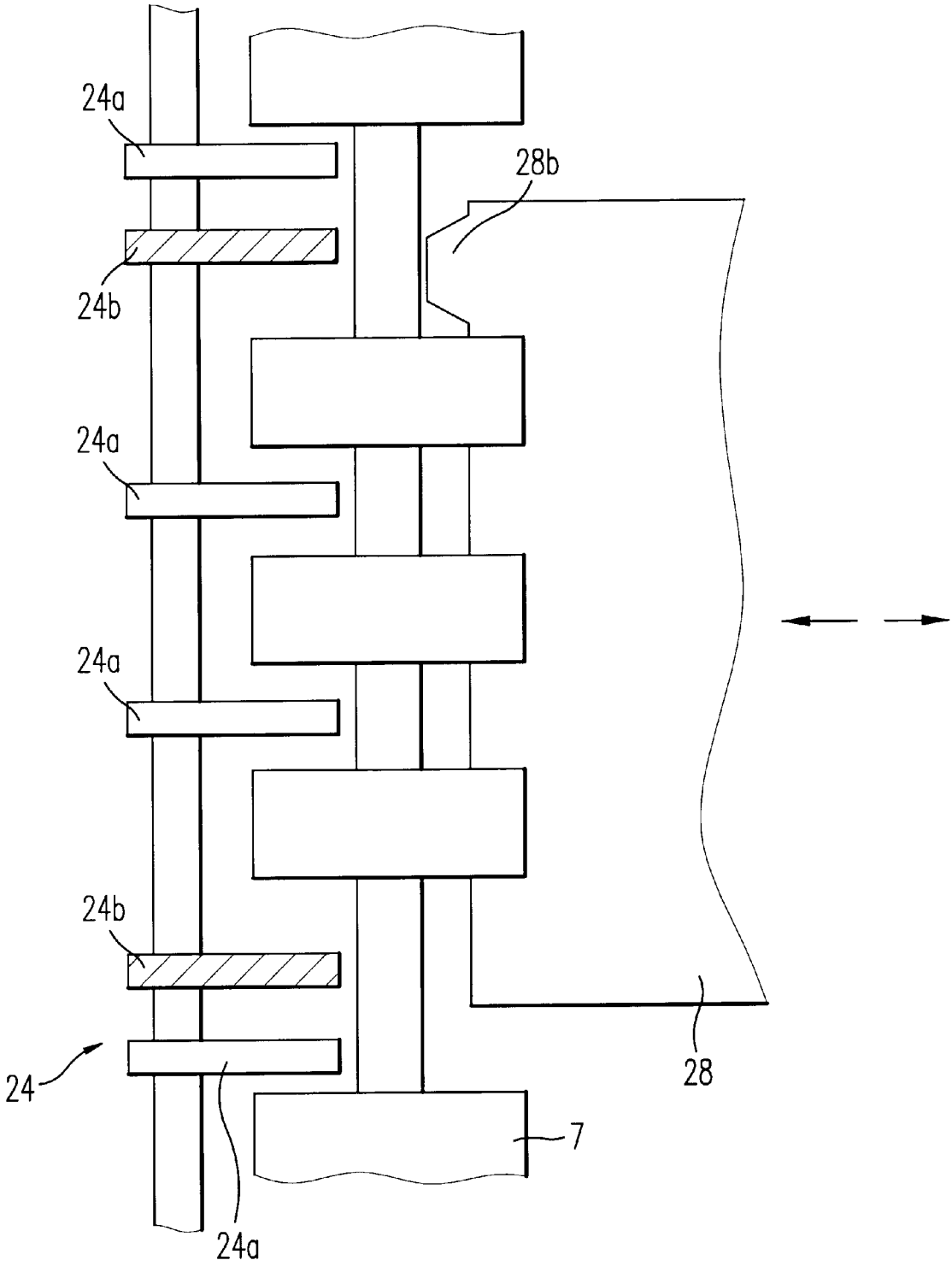
FIG. 6 is similar to FIG. 4, but shows a tabbed piece of paper.
Figure 7:
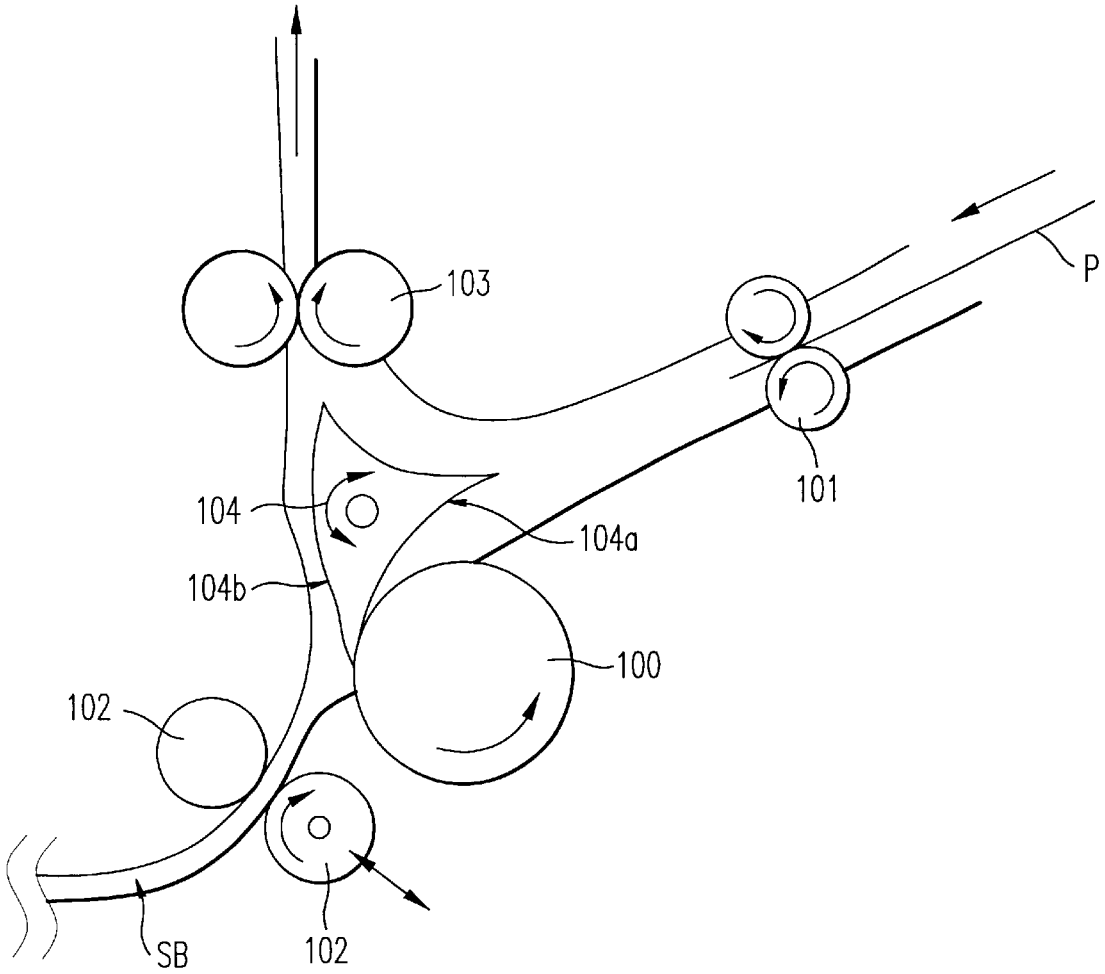
FIG. 7 shows a conventional reverse feeding device.
Figure 8:
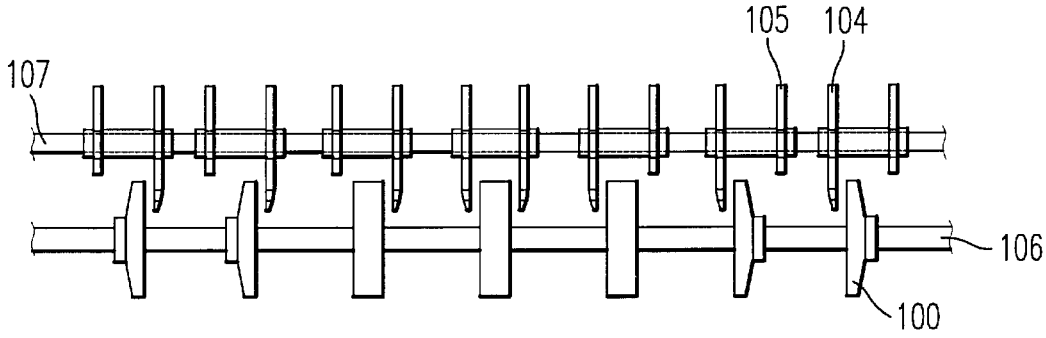
FIG. 8 is a longitudinal view of the feeding roller and the selector device of FIG. 7.
Figure 9A:
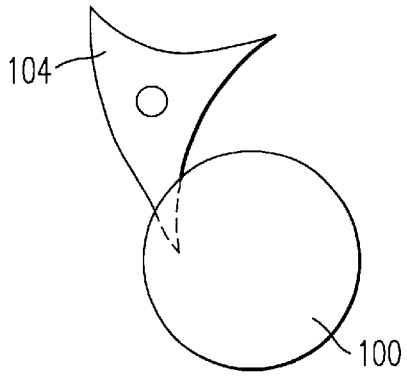
FIG. 9(*a*) is a side view of the feeding rollers and the branch nails of FIG. 7 when there is no paper between them.
Figure 9B:
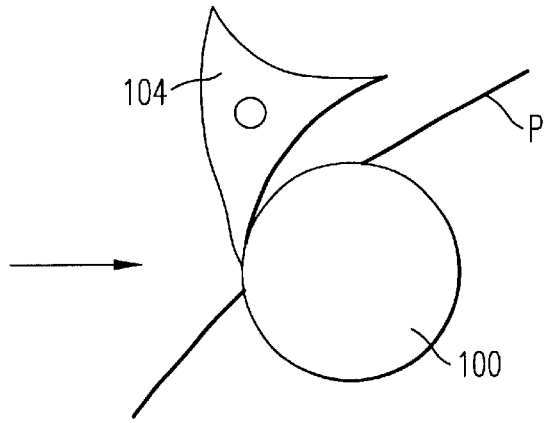
Figure 9C:
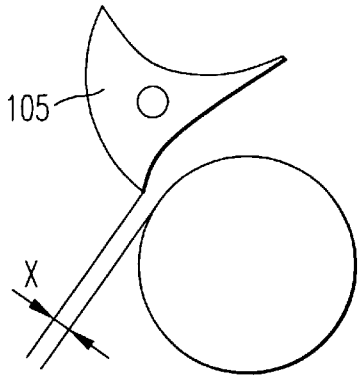
Figure 10:
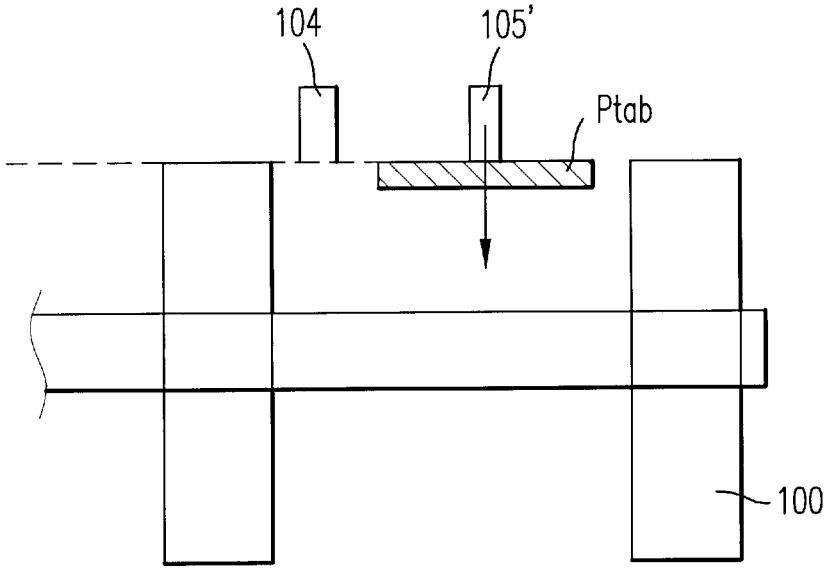
FIG. 10 shows a hypothetical case where the conventional guiding nail overlaps the feeding rollers.
Figure 11:
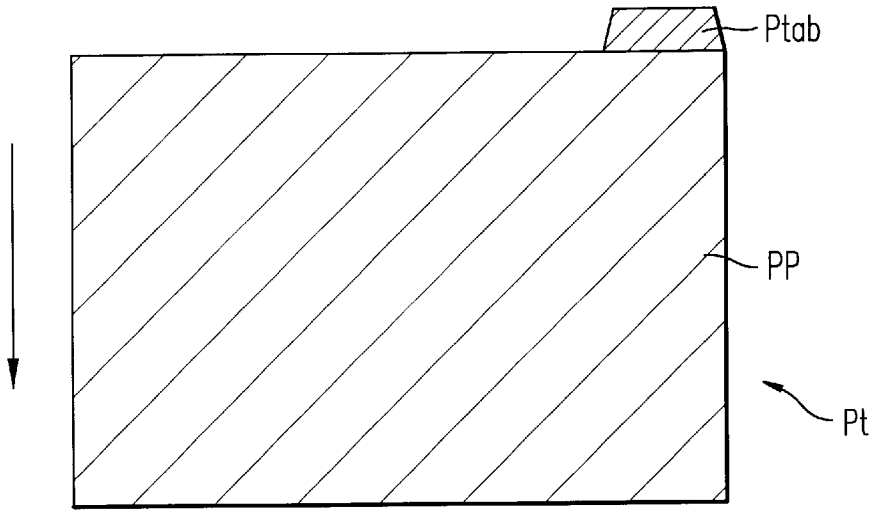
FIG. 11 shows a tab paper sheet.

Guiding nails 24*b* are also supported by the shaft 24*c*. The guiding nails 24*b* are positioned farther from the feeding rollers 7 in the axial direction of the shaft 24*c*. Both side edges of a regular sized sheet of paper are located in the areas where the guiding nails 24*b* are set. Accordingly, as shown in FIG. 6, a tab-area 28*b* of the paper 28 is engaged by one of the guiding nails 24*b*. Feeding rollers 7 are not located at these areas, because if a feeding roller 7 were to be located at these areas, sides of the front end would be crimped by a collision with the feeding roller 7, as the sides of the front end of the paper are usually curved. Therefore, the tab-area 28*b* is not caught by the feeding rollers 7.

The guiding nails 24*b* have the function to guide the paper when the front end of the paper is introduced to the feeding rollers 7. The guiding nails 24*b* also have the function to guide the front end, which has changed from the back end, toward the path III when the paper is fed by the reverse roller 8. However the guiding nails 24*b* do not have the function of pressing the paper to increase friction between the paper and the feeding rollers 7, which is the function of the branch nails 24*a*.

Figure 5A:
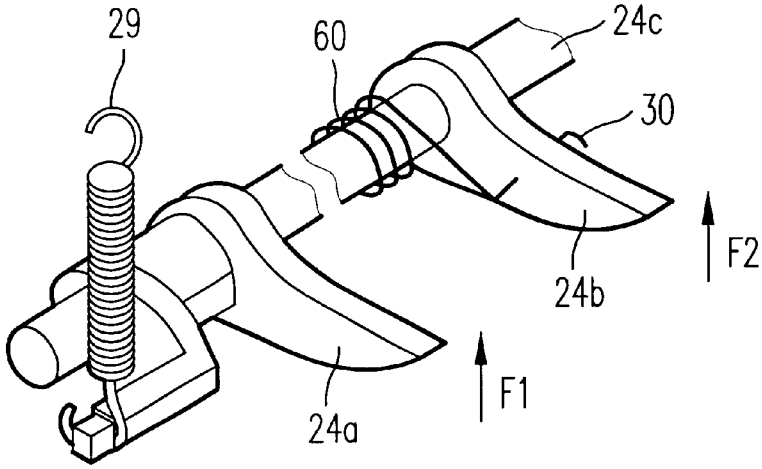
FIG. 5(*a*) shows the construction of the branch nails and the guiding nails.
Figure 5B:
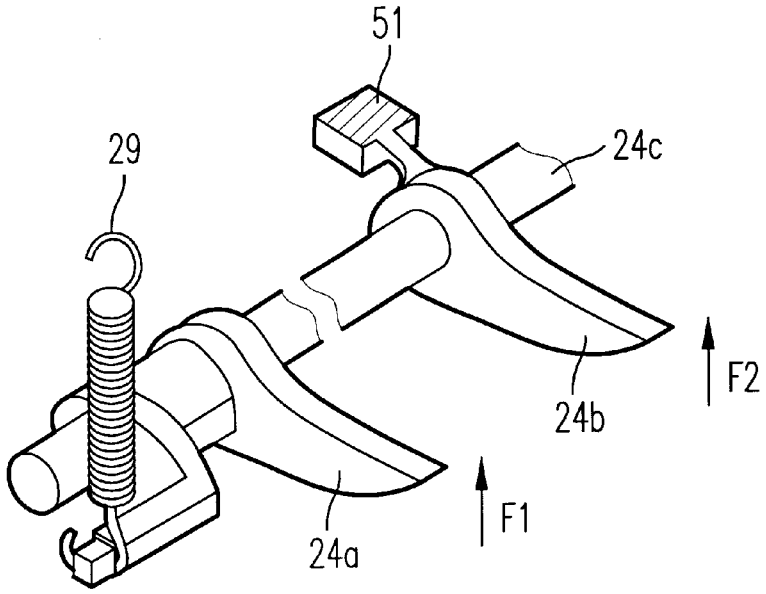

FIG. 5(*a*) shows a possible construction of the branch nails 24*a* and the guiding nails 24*b*. Each of the branch nails 24*a* and the guiding nails 24*b* is mounted to be individually rotatable on the shaft 24*c* within a limited range. The shape of the guiding nails 24*b* is the same as the shape of the branch nails 24*a*. The branch nails 24*a* are pulled upward by a spring 29 connected to a spring lever arm which is connected to each of the branch nails 24*a*. The force of the spring 29 is adjusted so that the tips of the branch nails 24*a* apply a pressure F1 on a paper sheet. The guiding nails 24*b* are pulled upward by a torsion coil 60 wound around the shaft 24*c*. The force of the coil 60 is adjusted so that the tips of the guiding nails 24*b* apply a pressure F2.

The pressure F2 is much smaller than the pressure F1. To be more specific, the pressure F2 satisfies the following condition. When the tab-area 28*b* travelling in path II-1 is fed past an upper face of the guiding nails 24*b*, the tab-area 281) can pass by the guiding nails 24*b* due to the inertia of the paper 28. On the other hand, when the lower faces of the guiding nails 24*b* guide the front-end of the paper 28 in its reverse travel in path II-2, the tips of the guiding nails 24*b* are lifted up by the pressure F2.

FIG. 5(*b*) is a modification of the guiding nails 24*b*, in which weights 51 are mounted opposite the tips of the guiding nails 24*b*, instead of the torsion coil 60, to provide the force F2.

As the shape of the guiding nails 24*b* is the same as the shape of the branch nails 24*a*, when the tips of the guiding nails 24*b* extend between the feeding rollers 7, the paper which has been switched back and fed to the feeding rollers 12, 13 is guided with reliability, even if the paper has the tab-area 28*b* or the paper is curved.

What is claimed as new and is desired to be secured by Letters Patent of the United States is:

1. A reverse feeding apparatus for switching back and feeding a sheet, comprising:

at least one feeding roller positioned for feeding a sheet in a first direction from an upstream path to a downstream path;

a reverse feeding roller located at the downstream path and positioned for feeding a sheet in a second direction that is different from the first direction;

at least one branch nail movably mounted adjacent the feeding roller; at least one guiding nail movably mounted adjacent the feeding roller, wherein a tip of the branch nail and a tip of the guiding nail are positionable to overlap the feeding roller when the sheet is not being fed in the first direction by the feeding roller, a branch nail pressing device which presses the branch nail to the position overlapping the feeding roller, to increase friction between a sheet being fed in the first direction and the feeding roller; and a guiding nail pressing device which presses the guiding nail to the position overlapping the feeding roller to permit a front end of a sheet being fed in the second direction to pass by a lower face of the guiding nail, wherein the pressure applied by said guiding nail pressing device is smaller than the pressure applied by said branch nail pressing device.

2. The reverse feeding device according to claim 1, wherein the feeding roller is positioned where a center part of a sheet moving in said upstream or downstream path passes through, wherein the branch nail is positioned nearer to the feeding roller than the guiding nail, and wherein the guiding nail is positioned where a side of a sheet moving in said upstream or downstream path passes said feeding roller.

3. The reverse feeding device according to claim 1, wherein the pressure applied by said guiding nail pressing device is set such that the inertial movement of a sheet moving in said upstream path is not obstructed by the guiding nail.

4. The reverse feeding device according to claim 1, wherein there are a plurality of said feeding rollers spaced in an axial direction of the rotation thereof, and wherein there are a plurality of said branch nails and said guiding nails spaced in said axial direction and interleaved with at least some of said feeding rollers.

5. The reverse feeding device according to claim 4, wherein the feeding rollers are positioned where a center part of a sheet moving in said upstream or downstream path passes the feeding rollers, wherein the branch nails are positioned nearer to the feeding rollers than the guiding nails, and wherein the guiding nails are positioned where sides of a sheet moving in said upstream or downstream path passes said feeding rollers.

6. The reverse feeding device according to claim 1, wherein said branch nail pressing device comprises a spring.

7. The reverse feeding device according to claim 1, wherein said guiding nail pressing device comprises a spring.

8. The reverse feeding device according to claim 1, wherein said guiding nail pressing device comprises a weight.

9. The reverse feeding device according to claim 1, wherein said branch nail and said guiding nail are identical in shape.

10. The reverse feeding device according to claim 1, wherein there are a plurality of said feeding rollers spaced in an axial direction of the rotation thereof, and wherein there are a plurality of said branch nails and said guiding nails spaced in said axial direction and interleaved with at least some of said feeding rollers.

11. A reverse feeding apparatus for switching back and feeding a sheet, comprising:

feeding roller means for feeding a sheet in a first direction from an upstream path to a downstream path;

reverse feeding roller means for feeding a sheet in a second direction that is different from the first direction;

at least one branch nail movably mounted adjacent the feeding roller means;

at least one guiding nail movably mounted adjacent the feeding roller means, wherein a tip of the branch nail and a tip of the guiding nail are positionable to overlap the feeding roller means when the sheet is not being fed in the first direction by the feeding roller means, branch nail pressing means for pressing the branch nail to the position overlapping the feeding roller means to increase friction between a sheet being fed in the first direction and the feeding roller means; and guiding nail pressing means for pressing the guiding nail to the position overlapping the feeding roller means to permit a front end of a sheet being fed in the second direction to pass by a lower face of the guiding nail, wherein the pressure applied by said guiding nail pressing means is smaller than the pressure applied by said branch nail pressing means.

12. The reverse feeding device according to claim 11, wherein the feeding roller means is positioned where a center part of a sheet moving in said upstream or downstream path passes said feeding roller means, wherein the branch nail is positioned nearer to the feeding roller means than the guiding nail, and wherein the guiding nail is positioned where a side of a sheet moving in said upstream or downstream path passes said feeding roller means.

13. The reverse feeding device according to claim 11, wherein the pressure applied by said guiding nail pressing means is set such that the inertial movement of a sheet moving in said upstream path is not obstructed by the guiding nail.

14. The reverse feeding device according to claim 11, wherein said branch nail and said guiding nail are identical in shape.

15. A method for switching back and feeding a sheet, comprising the steps of:

using at least one feeding roller to feed a sheet in a first direction from an upstream path to a downstream path;

using a reverse feeding roller located at the downstream path to feed the sheet in a second direction that is different from the first direction;

using at least one branch nail movably mounted adjacent the feeding roller to press the paper sheet being fed in the first direction toward the at least one feeding roller; and using at least one guiding nail movably mounted adjacent the feeding roller to guide the sheet being fed in the second direction without obstructing the inertial movement of the sheet in the first direction.

* * * * *